United States Patent [19]

Bodenmann

[11] 4,331,164

[45] May 25, 1982

[54] ASH-TRAY

[75] Inventor: Peter Bodenmann, Pfaffhausen, Switzerland

[73] Assignee: Albin Steinmann, Wallisellen, Switzerland; a part interest

[21] Appl. No.: 134,063

[22] Filed: Mar. 26, 1980

[30] Foreign Application Priority Data

Apr. 3, 1979 [CH] Switzerland ..... 3077/79

[51] Int. Cl.[3] ..... A24F 13/18; A24F 19/14

[52] U.S. Cl. ..... 131/235 R; 131/242

[58] Field of Search ..... 131/235, 237, 240 E, 131/242

[56] References Cited

U.S. PATENT DOCUMENTS

| | | | |
|---|---|---|---|
| 2,069,400 | 2/1937 | Berg | 131/235 R |
| 2,352,198 | 6/1944 | Hinson | 131/242 X |
| 2,795,231 | 6/1957 | Lucido | 131/235 R |
| 2,936,765 | 5/1960 | Talkington | 131/235 R |
| 2,963,027 | 12/1960 | Hercules | 131/235 R |

*Primary Examiner*—Stephen C. Pellegrino

*Attorney, Agent, or Firm*—Frishauf, Holtz, Goodman & Woodward

[57] ABSTRACT

An ash-tray of the kind having an ash compartment and a moveable closing element, which normally seals the compartment to prevent any unpleasant smell, comprises an upwardly extending sleeve supported above the ash compartment and which is closed off at the bottom by a pivotable flap. To extinguish the glowing part of a cigarette stub or the like the stub is dropped into the closely fitting sleeve and, after a few seconds, the glowing ember is smothered. The cigarette stub can thereafter be dropped down into the ash compartment by downward pressure on an actuating member to open the flap via a pin.

13 Claims, 3 Drawing Figures

ASH-TRAY

BACKGROUND OF THE INVENTION

The invention relates to an ash-tray of the kind having a compartment for ashes and a moveable closing element, normally a flap, which closes off the ash compartment.

Numerous types of such ash-trays are already known, including some in which the ash compartment can be closed off by a flap which covers over the entire opening of the ash-tray.

The invention is intended to solve the problem of providing an ash-tray of this kind in which it is possible to extinguish a glowing stub in a simple way, and at the same time prevent any unpleasant smell from ashes or the remains of the smoking item.

SUMMARY OF THE INVENTION

According to the invention an ash tray of the kind referred to above comprises a spring loaded flap closing an ash compartment, and an actuating means being provided to selectively open the spring loaded flap.

By utilising an ash-tray according to the invention, the glowing part of a cigarette or other smoking item no longer needs to be stubbed out since it is extinguished after a short time interval within the bore of said sleeve. In addition, any unpleasant smell is avoided.

In order that the invention may be readily understood, two embodiments of an ash-tray in accordance with the invention will now be described with reference to the accompanying drawings.

DETAILED DESCRIPTION

Figure 1:
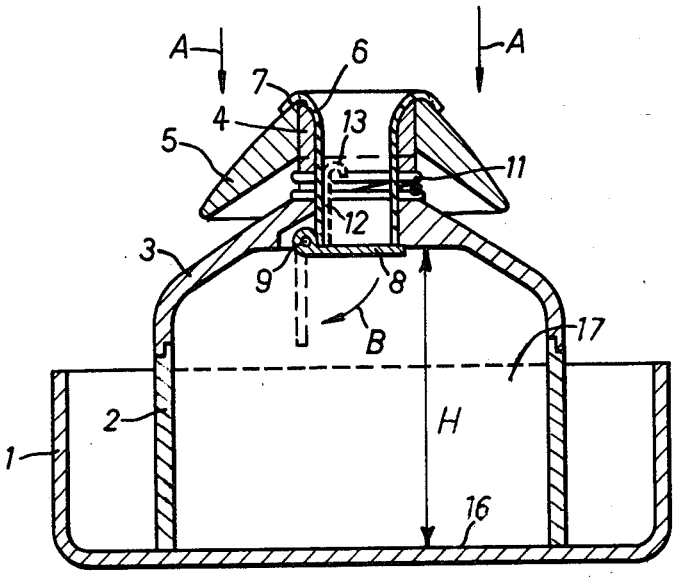
FIG. 1 shows the first embodiment of the ash-tray in vertical section.
Figure 2:
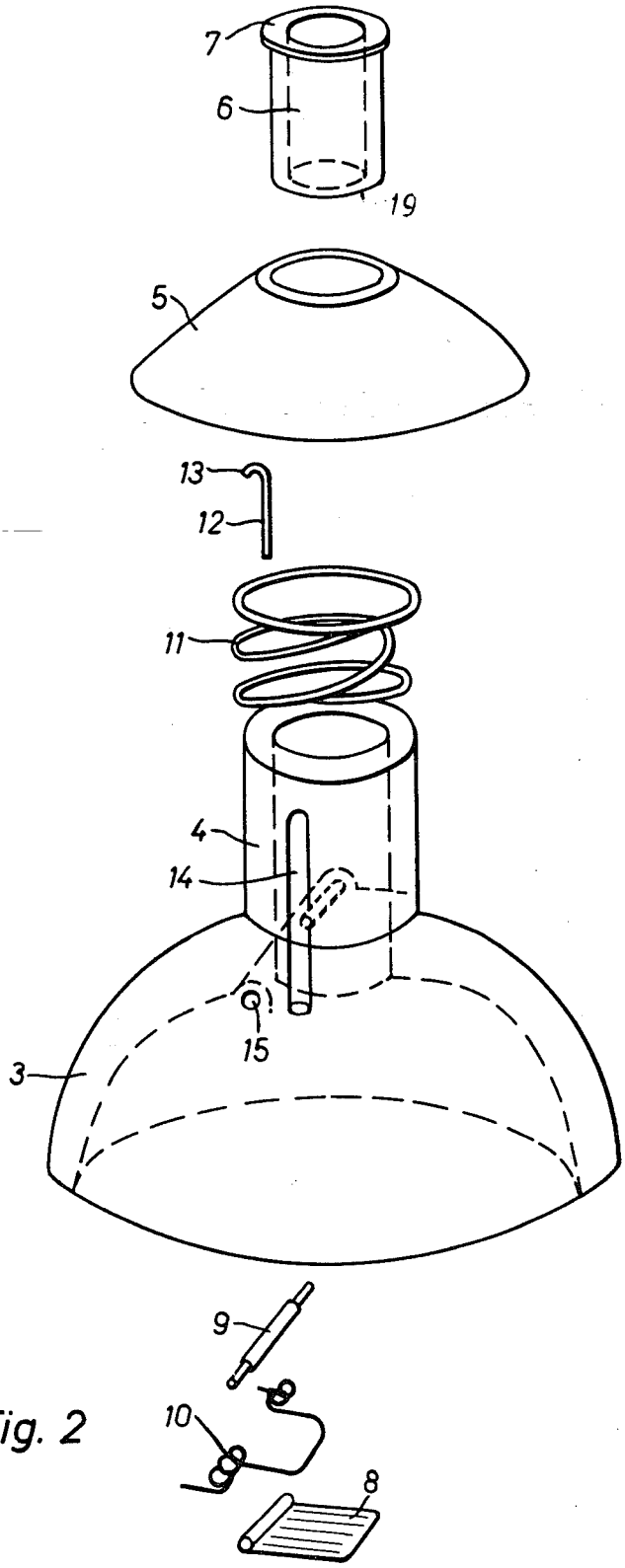
FIG. 2 is an exploded perspective view of the ash-tray shown in FIG. 1.

The ash-tray shown in FIGS. 1 and 2 contains a dish-shaped ash compartment 1, from the floor 16 of which a cylindrical insert part 2 projects upwards. This insert part may be either made in one piece with the ash compartment or connected to the latter as a separate part, for example glued in. A domed cap 3 is removably located on the insert part 2, via a connection comprising inter-engaging clamping parts or threads which provides a seal against smoke. The domed cap 3 continues in its upper section in the form of a cylindrical extension 4 of smaller diameter and has a vertical bore in which a metal sleeve 6 is coaxially inserted. This sleeve 6, which is fixedly supported in an upwardly extending attitude, is equipped at the top with a radially projecting edge 7 which rests on the end face of the cylindrical extension 4 and extends radially beyond it. A helical spring 11 is pushed over cylindrical extension 4 and rests against and pushes upwardly an actuating element in the form of a coaxially arranged annular disc 5 which is arched downwards. This annular disc 5 rests against the lip 7 which acts as a stop, as can be seen in FIG. 1. The internal diameter of the sleeve 6 exceeds the diameter of commercially available cigarettes only slightly and therefore has a bore of approximately 9–11 mm, and preferably approximately 10 mm. The bore is dimensioned so that there is slight play, amounting, for example, to around 10%, between the bore and a cigarette or other smoking item which is inserted. At the lower end of this sleeve 6 there is a pivotably mounted flap 8; this flap is mounted in the cap 3 by means of a horizontal pin 9 extending in a bore 15, and is pressed via a weak spring 10 against the lower end face of the sleeve 6 so that the ash compartment 17 is virtually sealed off. On the outside of the cylindrical extension 4 there is at least one longitudinal groove 14. In each groove 14 a pin 12 is engaged, being equipped at the top with a rounded part 13, or a head. The lower end of the or each pin 12 lies freely against the flap 8 near to the mounting position of the pin 12 so that only slight axial displacement of the pin 12 is sufficient to move the flap 8 into the fully open position shown in broken lines; thus in the direction of the arrow B in FIG. 1. The top of the rounded part 13 rests freely against the actuating element 5. Thus, with a downward movement of the hand, i.e. by a movement in the direction of the arrow A in FIG. 1, the flap 8 may be pivoted and the bore in the sleeve 6 thereby opened, while, when the downward pressure ceases, the actuating element 5 and with it the flap 8, return again to their original positions shown in FIG. 1, as the spring 10 is weaker than the spring 11.

The lower edge of the sleeve 6 is located some distance H above the floor 16 of the ash compartment 17, this distance H being at least as great as the dimensions of a normal cigarette stub together with an eventually existing filter. In practical terms, this distance should amount to more than 2 cm, and preferably more than 3 cm.

A modified embodiment is provided by setting a cylindrical ring with the same diameter on the insert part 2 so that the distance between the cap 3, and thus the casing 6, and the floor 16 of the compartment is increased.

Figure 3:
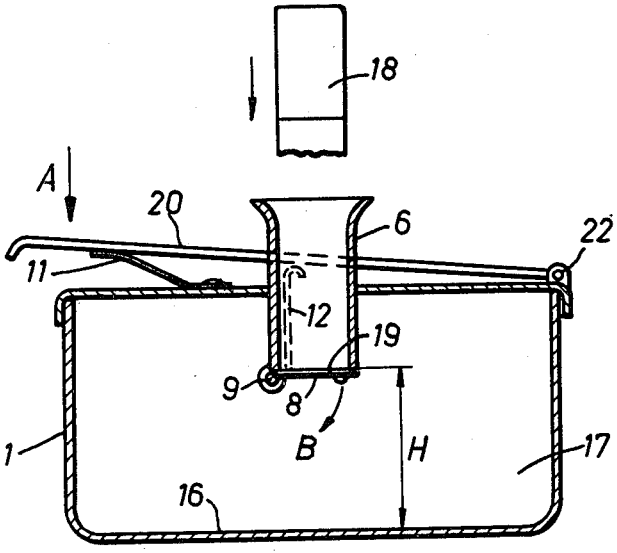
FIG. 3 shows the second embodiment of the ash-tray.

In FIG. 3 a modified embodiment is shown in which the basic construction is the same as in FIGS. 1 and 2 except that the actuating element is constructed as a pivotable rocker or lever 20, which can be pivoted about a horizontal pivot axis 22. In this instance, as well, there is a sleeve 6 which is rigidly connected to a lid. By pressing on the front face of the lever 20 (arrow A-FIG. 3) the flap 8 opens (arrow B-FIG. 1), whereupon a cigarette stub 18 dropped into the sleeve 6 falls under its own weight into the ash compartment 17.

In use, a burning cigarette, or some smoking item or the like, is inserted with the burning part foremost into the bore of the sleeve 6, and is initially prevented from falling down by the closed flap 8. In a surprising way, it is now found that after approximately 3–5 seconds the glowing ember is extinguished, since the supply of oxygen is not sufficient for the combustion process, as the gap between the bore in the sleeve and the stub of the cigarette is very small. After being extinguished, thus, after a few seconds, the actuating element 5 or 20 respectively is moved by hand in the direction of the arrow A, whereby the flap 8 is pivoted in the direction of the arrow B, thus, in the opening direction, and the cigarette stub, already extinguished in the interim, falls down under its own weight. After it is released, the actuating element 5 or 20 respectively moves upwards again under the effect of the spring 11, and as a result it also closes the flap 8 again, since the flap 8 is pivoted back by the relatively weak spring 10 into the closed position. In this way, the smell in the ash compartment 17 is completely sealed off, and no unpleasant smells can be released, as is frequently the case with open ash-trays.

With the exception of the sleeve 6, this ash-tray can be produced from plastic (Duroplast), which makes possible profitable mass production.

The bore in the sleeve may also be adapted to the normally somewhat larger diameter of smaller or larger cigars, instead of cigarettes.

I claim:

1. In an ash-tray of the kind including an ash compartment having a floor, and a moveable closing element which closes off the ash compartment at the top;

the improvement comprising:

a wall extending upwardly from the floor of the ash compartment;

an upwardly extending sleeve supported by said wall at a distance from the floor of the ash compartment;

said sleeve defining a bore which only slightly exceeds the diameter of given commercially available smoking items;

said moveable closing element comprising a spring-loaded flap pivotally connected at the lower terminal region of said sleeve around a horizontal axis for selectively opening and closing off said bore, said spring loading normally maintaining said flap in a position to close off said bore; and actuating means operatively coupled to said spring-loaded flap for pivotally moving said spring-loaded flap into an open position for opening the bore to such an extent to permit a smoking item to substantially freely fall through the bore of said sleeve and past said open spring-loaded flap, said actuating means comprising an annular disc member slideably and substantially coaxially mounted around said sleeve, a spring biasing said disc member upwardly relative to said sleeve, and an intermediate member operatively coupled between said disc member and said spring-loaded flap for causing said spring-loaded flap to open said bore when downward pressure is exerted on said disc member, said intermediate member including a pin or rod-shaped member slideably movable longitudinally of said sleeve, said pin or rod-shaped member being arranged to be slideably moved by said annular disc member to actuate said spring-loaded flap to the bore open position, whereby the stub of a smoking item inserted in said bore of said sleeve falls into the ash compartment which is located beneath it when said flap is actuated to its bore open position.

2. An ash-tray according to claim 1 wherein said pin or rod-shaped member is slideably mounted relative to said sleeve close to the horizontal pivotal axis of said flap so that a relatively short movement of said pin or rod-shaped member relative to said sleeve is sufficient to open said flap.

3. An ash-tray according to claim 1, wherein said ash compartment includes a cap-shaped part sealingly covering said ash compartment, said cap-shaped part continuing at the top into a cylindrical extension in which said sleeve is rigidly supported, said cylindrical extension forming an axial guide for said annular disc member.

4. An ash-tray according to claim 1 or 3, wherein the distance between the distance between the lower edge of said sleeve and the floor of said ash compartment is greater than 2 cm.

5. An ash-tray according to claim 4 wherein said distance between the lower edge of said sleeve and the floor of said ash compartment is greater than 3 cm.

6. An ash-tray according to claim 1, wherein said bore has a diameter about 10% greater than that of said smoking items.

7. An ash-tray according to claim 1, wherein said bore has a diameter of from 9 to 11 cm.

8. An ash-tray according to claim 1, wherein said bore has a diameter of about 10 cm.

9. An ash-tray according to claim 1, wherein said floor, wall, sleeve and flap define, when said flap is in a position to close off said bore, a substantially airtight chamber for prevention of escape of odors therefrom, and for extinguishing of embers or the like therein.

10. An ash-tray according to claim 1, wherein said upwardly extending wall comprises a lower wall section fixed to said floor, and an upper wall section removably connected to said lower wall section, said upper wall section supporting said upwardly extending sleeve.

11. An ash-tray according to claim 10, wherein said upper wall section substantially airtightly engages said lower wall section, and is removably connected to said lower wall section for opening the ash compartment for removal of ashes and the like therefrom.

12. An ash-tray according to claim 10 or 11, wherein said floor, lower wall section, upper wall section, sleeve and flap define, when said flap is in a position to close off said bore of said sleeve, a substantially airtight chamber for prevention of escape of odors therefrom, and extinguishing of embers or the like therein.

13. An ash-tray according to claim 1, wherein said pin or rod-shaped member is slideably guided in a longitudinal groove in said sleeve.

* * * * *